US008220917B2

(12) United States Patent
Taniuchi et al.

(10) Patent No.: US 8,220,917 B2
(45) Date of Patent: Jul. 17, 2012

(54) IMAGE FORMING APPARATUS WITH A PLURALITY OF APPLYING UNITS

(75) Inventors: Hiroshi Taniuchi, Yokohama (JP); Akihiro Mouri, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 79 days.

(21) Appl. No.: 12/353,783

(22) Filed: Jan. 14, 2009

(65) Prior Publication Data

US 2009/0128610 A1 May 21, 2009

Related U.S. Application Data

(62) Division of application No. 10/524,030, filed as application No. PCT/JP03/11297 on Sep. 4, 2003, now Pat. No. 7,494,213.

(30) Foreign Application Priority Data

Sep. 4, 2002 (JP) ..... 2002-258818
Sep. 4, 2002 (JP) ..... 2002-258819

(51) Int. Cl.
*B41J 2/01* (2006.01)

(52) U.S. Cl. ..... 347/103; 347/96; 347/100

(58) Field of Classification Search ..... 347/103, 347/101, 95–100
See application file for complete search history.

(56) References Cited

U.S. PATENT DOCUMENTS 4,538,156 A 8/1985 Durkee et al.
4,725,849 A 2/1988 Koike et al. ..... 347/106
5,099,256 A 3/1992 Anderson
5,372,852 A 12/1994 Titterington et al.
5,380,769 A 1/1995 Titterington et al.
5,389,958 A 2/1995 Bui et al.
5,858,514 A 1/1999 Bowers ..... 428/32.24
5,908,541 A 6/1999 Castegnier ..... 204/486
6,000,793 A 12/1999 Inamoto ..... 347/101
6,059,407 A 5/2000 Komatsu et al. ..... 347/103

(Continued)

FOREIGN PATENT DOCUMENTS

EP 0 583 168 2/1994

(Continued)

OTHER PUBLICATIONS

American Urethane—http://www.americanurethane.com/adiprene.htm, Jul. 19, 2007.

(Continued)

*Primary Examiner* — Matthew Luu
*Assistant Examiner* — Rut Patel
(74) *Attorney, Agent, or Firm* — Fitzpatrick, Cella, Harper & Scinto

(57) ABSTRACT

An image forming apparatus includes first, second, and third applying units, as well as a transferring portion. The first applying unit applies a first liquid to an intermediate transfer medium. The first liquid may be a liquid for increasing the wettability of the surface the intermediate transfer medium or a surfactant. The second applying unit applies a second liquid to intermediate transfer medium. The second liquid may be a liquid for decreasing the flowability of ink to the intermediate transfer medium, or a liquid for aggregating a color material, or a liquid which reacts with an ink. The third applying unit applies ink to the intermediate transfer medium, to which liquids have been applied. The ink is applied from an ink-jet head to form an image on the intermediate transfer medium.

16 Claims, 1 Drawing Sheet

U.S. PATENT DOCUMENTS

| | | | | |
|---|---|---|---|---|
| 6,109,746 | A | 8/2000 | Jeanmaire et al. | 347/103 |
| 6,196,674 | B1 | 3/2001 | Takemoto | 347/103 |
| 6,196,675 | B1 * | 3/2001 | Deily et al. | 347/103 |
| 6,234,625 | B1 | 5/2001 | Wen | 347/101 |
| 6,318,853 | B1 | 11/2001 | Asano et al. | 347/103 |
| 6,398,357 | B1 | 6/2002 | Holloway et al. | 347/100 |
| 6,623,816 | B1 | 9/2003 | Tanikawa et al. | 428/32.12 |
| 6,709,096 | B1 | 3/2004 | Beach et al. | 347/103 |
| 6,716,562 | B2 * | 4/2004 | Uehara et al. | 430/125.3 |
| 6,932,469 | B2 | 8/2005 | May et al. | 347/103 |
| 7,419,257 | B2 | 9/2008 | Mouri et al. | |
| 2001/0022607 | A1 | 9/2001 | Takahashi et al. | |
| 2003/0175048 | A1 | 9/2003 | Berg et al. | 399/237 |
| 2004/0056378 | A1 | 3/2004 | Bredt et al. | 264/109 |
| 2004/0202832 | A1 | 10/2004 | Nigam et al. | 428/195.1 |
| 2005/0007398 | A1 | 1/2005 | Hirai | 347/1 |

FOREIGN PATENT DOCUMENTS

| | | |
|---|---|---|
| EP | 0 606 490 | 7/1994 |
| EP | 0 739 743 | 10/1996 |
| EP | 0 938 974 | 9/1999 |
| JP | 62-92849 | 4/1987 |
| JP | 5-330035 | 12/1993 |
| JP | 7-89067 | 4/1995 |
| JP | 7-223312 | 8/1995 |
| JP | 7-256873 | 10/1995 |
| JP | 9-207424 | 8/1997 |
| JP | 2916864 | 4/1999 |
| JP | 11-179896 | 7/1999 |
| JP | 11-320865 | 11/1999 |
| JP | 11-334196 | 12/1999 |
| JP | 2000-318300 | 11/2000 |
| JP | 2001-347747 | 12/2001 |
| WO | WO 94/01283 | 1/1994 |

OTHER PUBLICATIONS

Modern Language (MLA): "surfactant," The American Heritage® Science Dictionary, Houghton Mifflin Company, Jul. 19, 2007, <Dictionary.com http://dictionary.reference.com/browse/surfactant>.

* cited by examiner

IMAGE FORMING APPARATUS WITH A PLURALITY OF APPLYING UNITS

This application is a division of U.S. patent application Ser. No. 10/524,030, filed Feb. 9, 2005, which is a national phase of PCT/JP03/11297, filed Sep. 4, 2003.

TECHNICAL FIELD

The present invention relates to an image forming process and an image forming apparatus using an ink-jet recording system, and particularly to an image forming process hard to be affected by the ink absorbing quantity of a recording medium used and an image forming apparatus used for realizing this process.

BACKGROUND ART

At present, the formation of an image using paper as a recording medium is mainly performed by offset printing. The offset printing is suitable for mass production because it can provide high-quality prints at high speed, and the production cost per sheet can be greatly reduced because of the mass production. The reason for it is that once a plate is fabricated by a plate-making step, a great number of reproductions can be made on the basis of this plate, and so the proportion of plate making cost required of individual prints can be lessened. Such offset printing has well matched with the needs of the market to date.

When the provision of prints of various kinds and small lots has advanced with the diversification of information in recent years, however, a problem that the plate cost to the individual prints becomes high, and so the price is comparatively expensive has arisen. Further, a further importance has been given to the immediateness of information in recent years, and a demand for an earlier appointed date of delivery in market that "a person wants to immediately obtain a print" is increasing. Even with this demand, the reduction of the number of sheets printed does not line up with the earlier appointed date of delivery under the circumstances because the current offset printing requires a long time for the so-called lead time from the preparation of a manuscript to plate making and preparation for printing (stabilization of printing machines), while the printing time that is an actual processing time is not as long due to the output rate of about 9,000 sheets per minute. In addition, since vast equipment investment is required, and operations of all steps require great skill, the production base is limited, and it takes a long time from completion of the printing to delivery of a print to a customer.

From such change in market demand, attention has been paid to printing by an ink-jet recording system in recent years. The ink-jet recording system is such a system that an image pattern is recorded on a recording medium by non-contact without using any plate and is suitable for printing of small circulation because of the non-plate system. Due to the background of the age that the establishment of electronic (paperless) information has been advanced, and even image information has been able to be easily processed, the ink-jet recording system has become an expected information-recording system in cooperation with the fact that good prints can be immediately provided without need of highly expert knowledge or large-scaled equipment.

By the way, as a recent trend, it has been required that high-quality images can be recorded by the ink-jet recording system irrespective of the kind of a recording medium. However, the ink-jet recording system is significantly affected by the ink absorbency of a recording medium used, and so it is difficult to record a high-quality image irrespective of the kind of the recording medium. In particular, it is hard to record a high-quality image on recording media (including non-absorbent recording media that do not absorb an ink at all) that are poor in ink-absorbing ability. When recording is conducted on a recording medium poor in ink-absorbing ability, a phenomenon called bleeding in which ink droplets that are impacted adjacently mix with each other and/or a phenomenon called beading in which an ink droplet that has impacted previously attracts an ink droplet that is impacted subsequently causing aggregation of the ink droplets may occur, so that image quality is often deteriorated.

In order to prevent such bleeding and beading, it is effective to lower the flowability of inks used on such a recording medium. In the case of the ink-jet recording system, however, only low-viscosity inks high in flowability can be ejected in order to satisfy the ejection stability of the inks. In other words, the ink-jet recording system is required to have conflicting properties that ink flowability upon ejection must be made high, while ink flowability on a recording medium must be lowered.

In order to satisfy such conflicting requirements, there has been proposed such a system (image forming system using an intermediate transfer medium) that an ink image is formed on an intermediate transfer medium (hereinafter also referred to simply as "transfer medium"), and the ink image formed on the transfer medium is transferred to a desired recording medium to form the ink image on the desired recording medium (see, for example, U.S. Pat. Nos. 4,538,156 and 5,099,256, and Japanese Patent Application Laid-Open No. 62-92849). In this system, an ink ejected from an ink-jet head is caused to impact the intermediate transfer medium to lower the flowability of the ink to some extent, and an image formed by the ink, the flowability of which has been lowered, is then transferred from the transfer medium to a recording medium.

In order to achieve a high quality ink image on the recording medium after the transfer in the image forming system using such an intermediate transfer medium, it is important to obtain a high quality ink image on the intermediate transfer medium before the transfer. For that purpose, it is required to improve the ability (the degree of retaining the ink at the impact position without moving the ink from this position) to hold the ink image on the intermediate transfer medium. In the above-described reference documents, however, the ability to hold the ink image on the intermediate transfer medium is low, and so beading or bleeding occurs on the intermediate transfer medium like the above-described non-absorbent recording medium. It is accordingly desirable to lower the ink flowability on the intermediate transfer medium.

Various proposals have been made to solve such a problem involved in the transfer type ink-jet recording. For example, Japanese Patent Application Laid-Open No. 7-223312 has proposed a method in which an ink is ejected on an intermediate transfer medium as a hot-melt ink by heating an ink-jet head and an ink feed line, and the flowability of the ink is lowered by heat dissipation.

Japanese Patent Application Laid-Open No. 5-330035 has proposed a method in which an intermediate transfer medium is heated to facilitate the evaporation of water in an ink applied to the intermediate transfer medium, thereby lowering the flowability of the ink on the intermediate transfer medium.

Japanese Patent Registration No. 2916864 (JPA 6-240195) has proposed a method in which an intermediate transfer medium is coated with a liquid (reactive liquid) reactive to an ink, and droplets of the ink are caused to impact on this transfer medium to react the ink with the reactive liquid, thereby lowering the flowability of the ink on the intermediate transfer medium.

However, a technique by which the flowability of the ink on the intermediate transfer medium can be lowered to improve the ink image on the intermediate transfer medium, and also the ink image on the recording medium after the transfer, has not been realized by any of the above-described documents. For example, in the case where the hot-melt ink is used like Japanese Patent Application Laid-Open No. 7-223312, one must use an ink containing a binder in an extremely great proportion to a coloring material for the purpose of developing the phase change property (solid-liquid phase change by heat) of the ink. Therefore, the amount of the ink to be applied increases for the purpose of achieving a desired density. As a result, the thickness of the ink of an outputted image becomes great, thus leading to deterioration of image quality. In other words, this system cannot improve the quality of the ink image on the recording medium after the transfer, because a sense of incompatibility occurs in the ink image on the recording medium after the transfer due to the great thickness of the ink applied. In addition, since the ink solid at ordinary temperature is used, the ink within an ink flow path must be heated and melted upon start-up, and so it takes time to output an image. Further, since there is need to retain this state during operation, vast energy is required.

Beading and/or bleeding cannot be prevented by simply heating the transfer medium like Japanese Patent Application Laid-Open No. 5-330035 because the beading or bleeding of inks occurs before the ink flowability is sufficiently lowered, since the beading or bleeding occurs in the moment at the impact of the inks. This system only achieves the effect of drying the ink image formed on the transfer medium. The ability to hold the ink image on the transfer medium is still low, and so the quality of the ink image on the transfer medium cannot be improved, and the quality of the ink image on the recording medium cannot also be improved.

According to Japanese Patent Registration No. 2916864 (JPA 6-240195), the flowability of the ink on the intermediate transfer medium can be lowered. However, the quality of the ink image on the intermediate transfer medium cannot be made high. More specifically, since the reactive liquid itself is liquid, the beading of the reactive liquid occurs on the intermediate transfer medium when the intermediate transfer medium is coated with such a reactive liquid. As a result, an ink is ejected in such a state that the beading of the reactive liquid has occurred, so that the ink cannot be held at a normal position to fail to make the quality of the ink image on the transfer image high. Incidentally, when an intermediate transfer medium having a surface excellent in ink absorbency is used, a high-quality ink image can be formed on the intermediate transfer medium. However, the ink image sticks to the intermediate transfer medium, so that the ink image cannot be successfully transferred to the recording medium, and moreover cleaning becomes difficult.

As apparent from the above, to form a high-quality ink image on various recording media including recording media (for example, non-absorbent recording media) that are poor in ink-absorbing ability has not yet been realized, without being affected by the ink absorbency of the recording media, even in methods using the intermediate transfer medium. The same applies to a system in which an ink is directly ejected on a recording medium without using any intermediate transfer medium

SUMMARY OF THE INVENTION

The present invention can provide an image forming process, which permits recording of an image on a wide variety of recording media irrespective of the ink absorbency of a recording medium used without sacrificing the high recording flexibility of an ink-jet recording system, and an image forming apparatus used for realizing this process.

Such can be achieved by the present invention described below.

According to the present invention, there is thus provided an image forming process comprising the steps of:

applying a first material for improving the wettability of the surface of an intermediate transfer medium to the intermediate transfer medium, applying a second material for lowering the flowability of an ink to the intermediate transfer medium to which the first material has been applied, applying the ink to the intermediate transfer medium, to which the first material and second material have been applied, from an ink-jet recording head to form an image of the ink on the intermediate transfer medium, and transferring the ink image formed to a recording medium.

According to the present invention, there is also provided an image forming process for transferring an image of an ink formed on an intermediate transfer medium having a non-absorbent surface to a recording medium, thereby forming the ink image on the recording medium, which comprises the steps of:

applying a first material for enhancing the surface energy of the surface of the intermediate transfer medium to the intermediate transfer medium, applying a second material for aggregating a coloring material in the ink to the intermediate transfer medium to which the first material has been applied, applying the ink to the intermediate transfer medium, to which the first material and second material have been applied, from an ink-jet recording head to form the ink image on the intermediate transfer medium, and transferring the ink image formed to the recording medium.

In the above-described processes, the surface of the intermediate transfer medium may preferably be of a material containing fluorine or silicone. The surface of the intermediate transfer medium may also have a rubber hardness ranging from 10 to 100°. The first material may preferably be a liquid containing a surfactant. The position to which the first material is applied may preferably be changed according to an image to be formed. The second material may preferably be a liquid containing a metal ion. The position to which the second material is applied may also preferably be changed according to an image to be formed. The second material may preferably contain a surfactant. In the first mentioned process, at least one of the first material, second material and ink may preferably contain a crosslinking agent. The process may further comprise the step of facilitating the removal of a solvent contained in the ink image formed on the intermediate transfer medium. At least one of the first material and second material may preferably be applied by using a head of an ink-jet system.

According to the present invention, there is further provided an image forming process comprising the steps of:

applying a first liquid containing a surfactant to an intermediate transfer medium having a surface containing at least one material of a fluororubber and a silicone rubber, applying a second liquid for aggregating a coloring material in an ink to the intermediate transfer medium to which the first liquid has been applied, applying the ink to the intermediate transfer medium, to which the first liquid and second liquid have been applied, from an ink-jet recording head to form an image of the ink on the intermediate transfer medium, and transferring the ink image formed to the recording medium.

According to the present invention, there is still further provided an image forming apparatus for transferring an image of an ink formed on an intermediate transfer medium having a releasable surface to a recording medium, thereby forming the ink image on the recording medium, which comprises:

a first applying means for applying a first liquid for improving the wettability of the surface of the intermediate transfer medium to the intermediate transfer medium, a second applying means for applying a second liquid for lowering the flowability of the ink to the intermediate transfer medium to which the first liquid has been applied, and an ink-jet recording head for applying the ink to the intermediate transfer medium, to which the first liquid and second liquid have been applied, on the basis of image data.

According to the present invention, there is yet still further provided an image forming process comprising the steps of:

applying a first liquid for improving the wettability of a recording medium to the recording medium, applying a second liquid for lowering the flowability of an ink to the recording medium to which the first liquid has been applied, and applying the ink to the recording medium, to which the first liquid and second liquid have been applied, from an ink-jet recording head to form an image of the ink on the recording medium.

According to the present invention, there is yet still further provided an image forming process for forming an image of an ink on a recording medium having a non-absorbent surface, which comprises the steps of:

applying a first material for enhancing the surface energy of the surface of the recording medium to the recording medium, applying a second material for aggregating a coloring material in the ink to the recording medium to which the first material has been applied, and applying the ink to the recording medium, to which the first material and second material have been applied, from an ink-jet recording head to form the ink image on the recording medium.

According to the present invention, image forming processes and image forming apparatus are provided which permit recording of an image on a wide variety of recording media including recording media (for example, non-absorbent recording media) poor in ink absorbing ability irrespective of the ink absorbency of a recording medium used.

DETAILED DESCRIPTION OF THE PREFERRED EMBODIMENTS

Figure 1:
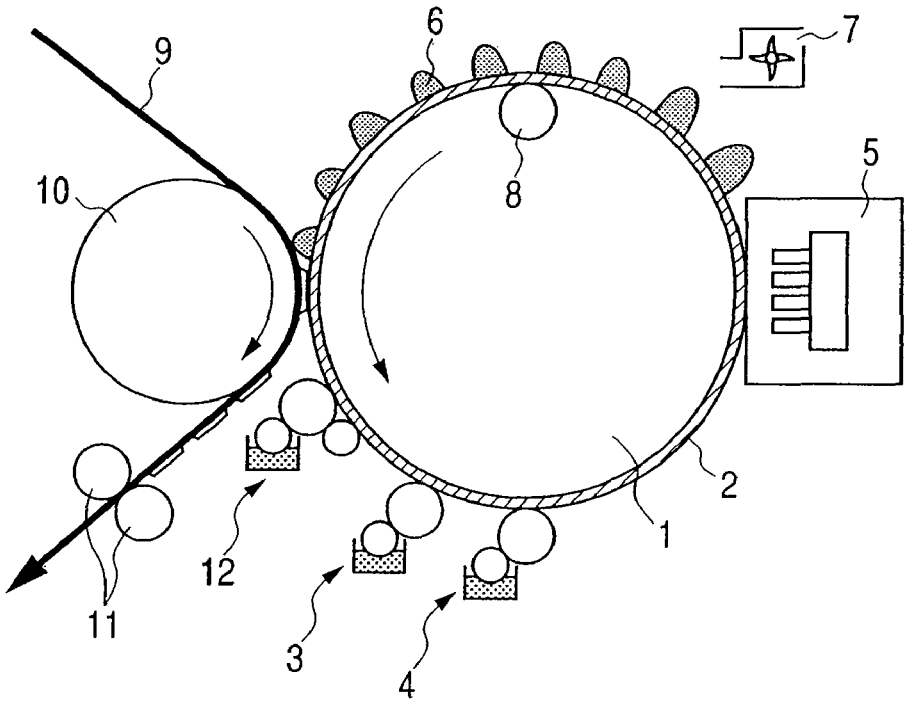
FIG. 1 illustrates a conceptual image forming apparatus according to the first embodiment of the present invention.

The present invention will hereinafter be described in more detail by the preferred embodiments of the present invention.

First Embodiment

The feature of the first embodiment of the present invention is first briefly described before this embodiment described in detail. The feature of the first embodiment resides in that a first material (wettability-improving component) for improving the wettability of the surface of an intermediate transfer medium is applied to the intermediate transfer medium before the application of a second material (image-fixing component) for lowering the flowability of an ink on the intermediate transfer medium for the purpose of permitting uniform application of the second material to the intermediate transfer medium or holding of the second material applied to the intermediate transfer medium at a desired position. By applying this first material, the image-fixing component is prevented from being repelled on the intermediate transfer medium, and so the beading of the image-fixing component does not occur. Therefore, the image-fixing component can be uniformly applied to the intermediate transfer medium, and the image-fixing component applied to the intermediate transfer medium can be held at the desired position. As a result, an ink is applied to the intermediate transfer medium in such a state that the image-fixing component has been uniformly applied to the intermediate transfer medium or held at the desired position, so that the image-fixing component reacts with the ink at the desired position, and the ink can be held at the desired position on the intermediate transfer medium. The quality of an ink image on the intermediate transfer medium can be thereby made high. As a result, the quality of the ink image on a recording medium after transfer can be made high.

On the other hand, if a reactive liquid (image-fixing component) reactive to an ink is directly applied to an intermediate transfer medium like Japanese Patent Registration No. 2916864 (JPA 6-240195) described above, in other words, the image-fixing component is applied to the intermediate transfer medium to which no wettability-improving component has been applied, the image-fixing component is repelled on the surface of the intermediate transfer medium to cause the beading of the image-fixing component. Therefore, the image-fixing component cannot be uniformly applied to the intermediate transfer medium, or the image-fixing component applied to the intermediate transfer medium cannot be held at a desired position. As a result, an ink is applied to the intermediate transfer medium in such a state that the image-fixing component has been nonuniformly applied to the intermediate transfer medium or held at a position different from the desired position, so that the image-fixing component reacts with the ink at the position different from the desired position, and the ink is held at the position different from the desired position on the intermediate transfer medium. In other words, the ink cannot be held at the desired position on the intermediate transfer medium, whereby the quality of an ink image on the intermediate transfer medium is deteriorated. As a result, the quality of the ink image on a recording medium after transfer cannot be made high.

As described above, it is important to hold the image-fixing component for lowering the flowability of the ink on the intermediate transfer medium at the desired position on the intermediate transfer medium for the purpose of making the quality of the ink image on the transfer medium high, and it is thus important to apply the wettability-improving component before the application of the image-fixing component.

The first embodiment of the present invention will now be described in detail. FIG. 1 schematically illustrates an image forming apparatus according to the present invention used in realizing the image forming process according to the first embodiment. In FIG. 1, reference numeral 1 is an intermediate transfer medium having a surface layer 2. The image forming apparatus has a coating device 4 for applying the image-fixing component, a coating device 3 for applying the wettability-improving component and an ink-jet recording apparatus 5 for forming an ink image 6 by ejecting ink droplets from an ink-jet recording head around the intermediate transfer medium. The intermediate transfer medium 1 is rotated in the direction of the arrow in FIG. 1, and the wettability-improving component is first applied to the surface thereof by the coating device 3. Thereafter, the image-fixing component is applied by the coating device 4. After these components are applied, ink droplets are ejected from the ink-jet recording apparatus 5 to form an ink image 6 on the surface of the intermediate transfer medium 1. A recording surface of a recording medium 9 is then brought into contact with the surface of the intermediate transfer medium 1 by pressing the recording medium 9 against the transfer medium by a press roller 10, whereby an image is formed on the recording medium 9. In the apparatus illustrated in FIG. 1, a device 7 for facilitating the removal of water is arranged to remove water in the ink forming the image on the intermediate transfer medium 1, and the image is then transferred to the recording surface of the recording medium 9. In the apparatus illustrated in FIG. 1, the surface of the intermediate transfer medium 1 is cleaned by a cleaning device 12, whereby the intermediate transfer medium can be used repeatedly plural times.

For the image forming process of the first embodiment of the present invention using the image forming apparatus having the above-described construction, the kinds of recording media are not very limited, and a high quality image can be outputted on nearly every recording medium. More specifically, since the fixing of an ink in the ordinary ink-jet recording system is achieved by penetration of the ink into paper that is a recording medium, the condition of the image is changed by the quantity of the ink absorbed into the recording medium, or no image can be formed on non-absorbent medium. On the other hand, the offset printing machine is intended to provide a great number of the same prints, and cannot output a different image on every recording medium. In the present invention, however, the image forming process solving these drawbacks at the same time is provided.

The process constituting the image forming process according to the first embodiment of the present invention may be divided into the following four steps. Members or devices (apparatus) used for practicing these steps will hereinafter be described in detail.

1. Step (a): Step of Applying the Wettability-Improving Component to the Intermediate Transfer Medium As the form of the intermediate transfer medium used in this step, may be used a form of a roller, belt, sheet (for continuous treatment), pad (for batch treatment) or the like. In the embodiment illustrated in FIG. 1, an intermediate transfer medium in the form of a drum made from a light metal such as an aluminum alloy is selected from requirements such as stiffness necessary for withstanding pressure during transfer, dimensional accuracy and reduction of rotational inertia.

The surface layer 2 may have some ink permeability (ink absorbency) when the intermediate transfer medium is not used repeatedly. However, a non-permeable (non-absorbent) material is used when the intermediate transfer medium is used repeatedly. Even when the material is permeable, it can be used repeatedly so far as it is a material that can be cleaned by cleaning. However, the permeable material is not said to be preferable even from the viewpoints of use efficiency of the material, image quality and cleanability of the intermediate transfer medium because it is poor in ink transfer rate, and so a greater amount of an ink must be applied to the intermediate transfer medium. The material of the surface layer on the intermediate transfer medium is preferably a non-permeable (non-absorbent) material, more preferably a releasable material from the viewpoints of transfer rate and cleanability. The term "releasability" as used herein means property that an ink and materials such as the image-fixing component and wettability-improving component are hard to adhere to the surface to be releasable later on. The higher the releasability, advantage is given from the viewpoints of load in cleaning and the transfer rate of the ink. On the contrary, the critical surface tension of the material becomes low, a liquid such as the ink is easy to be repelled even if it is applied, and it is difficult to hold an image of the ink. With respect to the standard as a suitable releasable material in the present invention, the critical surface tension is 30 mN/m or lower, or the contact angle with water is 75° or greater.

More specifically, the surface layer 2 may be formed on the surface of the intermediate transfer medium 1 by a surface treatment such as processing with Teflon or application of silicone oil. Taking follow-up property to the recording medium into consideration, however, it is preferably composed of an elastic material. Preferable effects are brought about by a rubber hardness (as measured by a rubber hardness meter in accordance with JIS K 6253) ranging from 10 to 100°. When the hardness is 40 to 80°, such a surface layer can cope with almost all recording paper sheets. More specifically, NBR, urethane rubber, chloroprene rubber and surface treated products thereof, and fluororubber, silicone rubber and fluorosilicone rubber may be suitably used, as the materials themselves have ink-repelling property. The surface form of the surface layer 2 is not limited. The form thereof may be selected taking the surface form of a recording medium used and the effect on printing into consideration. For example, when an image such as an offset print is desired, a smooth surface form may preferably be selected for a smooth recording medium. On the contrary, when a form high in roughness or a surface such as a gravure cell is used for a recording medium, an effect of printing according to the invention can also be achieved. In the following description, "the surface of the intermediate transfer medium" means "the surface of the surface layer on the intermediate transfer medium" unless expressly noted otherwise.

In Step (a), the wettability-improving component is applied to such an intermediate transfer medium 1 as described above by using the coating device 3 (see FIG. 1). The wettability-improving component means a material for improving the wettability of the surface of the intermediate transfer medium, and a liquid containing a surfactant is suitably used. The component plays a role of enhancing the surface energy of the surface of the intermediate transfer medium to make the image-fixing component subsequently applied hard to be repelled.

The reason why the wettability-improving component is applied is to uniformly apply the image-fixing component to the intermediate transfer medium or to permit holding of the image-fixing component at a desired position on the intermediate transfer medium as described above. When this step is not conducted, the image-fixing component causes beading on the intermediate transfer medium, and a state in which the image-fixing component is nonuniformly applied, or a state in which the component is present at a position different from the desired position is created. When an ink is applied in such a state to form an image, no image having high quality can be provided. It is considered that the step of applying the wettability-improving component is not conducted, but an image-fixing component, to which the wettability-improving component has been added, is applied. In this case, however, the amount of the wettability-improving component added is increased, so that not only image quality and drying characteristic, but also water fastness is adversely affected. In order to control the amount of the wettability-improving component applied to the minimum and achieve the desired effect to the maximum, it is more preferable to align and orient the surfactant on the surface of the intermediate transfer medium by applying the wettability-improving component singly and then apply the image-fixing component.

As the wettability-improving component, may be preferably used a surfactant. No particular limitation is imposed on the surfactant used. The surfactant may be selected according to the surface layer used from among, for example, general cationic surfactants, anionic surfactants, nonionic surfactants, amphoteric surfactants, fluorocarbon type surfactants and silicone type surfactants. Among these, fluorocarbon type or silicone type surfactants are preferable materials high in effect. The amount of the wettability-improving component applied is freely selected so far as it can be uniformly applied. However, the amount applied is preferably as little as possible from the viewpoints of image stability and drying characteristic. It is also possible to limit an area (position) to be applied. For example, the wettability-improving component may be applied only to an image-forming area (position to which the image-fixing component and ink are applied), thereby improving use efficiency of the material and drying characteristic. An applying means is not limited, and any conventionally known techniques may be used. Specific examples thereof include roll coater, spray coater and slit coater. When the position of the wettability-improving component to be applied is changed according to an image to be formed, an ink-jet head is a preferable applicator. As the surfactant applied, may be used a surfactant that is not liquid. The wettability-improving component may be applied by bringing, for example, a solid or waxy surfactant into contact with the surface of the intermediate transfer medium or sliding it on the surface.

2. Step (b): Step of Applying the Image-Fixing Component to the Intermediate Transfer Medium In Step (b), the image-fixing component is applied to the intermediate transfer medium, to which the wettability-improving component has been applied, by means of the coating device 4. The term "fixing of the image" as used herein means not only (1) the case where the viscosity of the ink is made high and (2) the case where a coloring material, a resin or the like that is a part of a composition making the ink is chemically reacted or physically absorbed to cause decrease in the flowability of the whole ink, but also the case where the local decrease in the flowability of the ink is caused by aggregation of the solid of the composition of the ink. In other words, the image-fixing component is a material for lowering the flowability of the ink on the intermediate transfer medium. In particular, a liquid for aggregating the coloring material in the ink is preferably used.

The reason why the image-fixing component is applied is to lower the flowability of the ink on the intermediate transfer medium so as to make it possible to successfully hold the ink image on the intermediate transfer medium as described above. In other words, since the surface of the intermediate transfer medium, to which the wettability-improving component has been applied, is in such a state that an ink is easier to flow, the ink flows unless the image-fixing component is applied, and defects such as bleeding and beading are caused. The image forming apparatus is therefore so constructed that the image-fixing component is applied before the application of the image-fixing component, and the ink is caused to impact on the image-fixing component. By this apparatus, the ink reacts with the image-fixing component at a position where the ink has impacted, so that the ink can be held at the position where the ink has impacted.

It is necessary to suitably select the image-fixing component used in Step (b) according to the kind of the ink used in the formation of an image. For example, it is effective to use a high-molecular coagulant for a dye ink, but it is effective to use a metal ion for a pigment ink in which fine particles are dispersed. Further, when a metal ion is used in combination as the image-fixing component for the dye ink, it is preferable to mix a pigment of the same hue as the dye or fine particles of a white color or transparent color scarcely affecting the hue into the ink.

In the present invention, examples of the high-molecular coagulant used as the image-fixing component include cationic high-molecular coagulants, anionic high-molecular coagulants, nonionic high-molecular coagulants and amphoteric high-molecular coagulants. Examples of the metal ion include divalent metal ions such as $Ca^{2+}$, $Cu^{2+}$, $Ni^{2+}$, $Mg^{2+}$ and $Zn^{2+}$, and trivalent metal ions such as $Fe^{3+}$ and $Al^{3+}$. When these metal ions are applied, it is desirable to apply them in the form of an aqueous solution of a metal salt. Examples of an anion for the metal salt include $Cl^-$, $NO_3^-$, $SO_4^-$, $I^-$, $Br^-$, $CO_3^-$ and $RCOO^-$ (R is an alkyl group). Further, a material having a nature opposite to that of the ink used may also be used as the image-fixing component. For example, when the ink is anionic or alkaline, a cationic or acid material having a nature opposite to the ink may become an image-fixing component.

In order to increase the affinity for the layer of the wettability-improving component formed previously, it is also effective in Step (b) to add the same surfactant as that used in Step (a) or a different surfactant to the image-fixing component. With respect to the amount of the image-fixing component applied, it is desirable that, for example, the overall number of charges of the metal ion should amount to at least once as much as the overall number of charges of the ion having the opposite polarity in the color ink. To do so, it is only necessary to use an aqueous solution of one of the above-described metal salts having a concentration of about 10% by mass. The coating layer in a thin film sufficiently functions. As the coating device 4 that is an applying means, a device using a roll coater is illustrated in FIG. 1. However, the present invention is not limited thereto. Such a coating device as described in the previous Step (a) is preferably used. As for a coated state, it is not essential to take a two-layer structure completely separated from the wettability-improving component formed previously. Some mixing of the components at a boundary layer does not become a factor that lowers the effect.

In order to improve transferability and fastness properties of an image finally formed, a resin component may also be added. A water-soluble resin or water-soluble crosslinking agent may also be added. No limitation is imposed on a material used so far as it can coexist with the image-fixing component. In particular, when a highly-reactive metal salt is used as the image-fixing component, PVA, PVP or the like is preferably used as the water-soluble resin. As the water-soluble crosslinking agent, is preferably used oxazoline or carbodiimide capable of reacting with a carboxylic acid that is preferably used for dispersing a coloring material in an ink. Further, alysine or the like is a material capable of comparatively reconciling both fixing of an image and fastness properties of the image with each other.

3. Step (c): Step of Ejecting an Ink on the Intermediate Transfer Medium to Form an Ink Image In Step (c), an ink is ejected from an ink-jet recording head of the ink-jet recording apparatus 5 on the intermediate transfer medium, to which both a wettability-improving component and an image-fixing component have been applied, to form an ink image 6 on the intermediate transfer medium. The reason why the ink-jet recording head is used as an image forming means in the present invention is that it is technically of non-contact recording in addition to the fact that it is a non-plate system. Even when the image-fixing component can be uniformly applied, it is difficult to apply the ink to the surface of the transfer medium high in releasability by any method of a contact system.

No particular limitation is imposed on the ink-jet recording system used, and an apparatus of a bubble-jet system, piezoelectric system or continuous system may be suitably selected for use. As the ink-jet head used, may be used either a line head or a serial head.

No particular limitation is imposed on the ink used in Step (c), and a water-based ink containing a general dye or pigment and an aqueous liquid medium for dissolving or dispersing this dye or pigment may be preferably used. When only the effect in printing is intended to be achieved, it goes without saying that the ink may be colorless. In particular, a pigment ink can provide a recorded image good in fastness properties, and moreover provide a particularly good image when a metal ion is used as the image-fixing component.

Specific examples of the dye used include C.I. Direct Blue 6, 8, 22, 34, 70, 71, 76, 78, 86, 142 and 199; C.I. Acid Blue 9, 22, 40, 59, 93, 102, 104, 117, 120, 167 and 229; C.I. Direct Red 1, 4, 17, 28, 83 and 227; C.I. Acid Red 1, 4, 8, 13, 14, 15, 18, 21, 26, 35, 37, 249, 257 and 289; C.I. Direct Yellow 12, 24, 26, 86, 98, 132 and 142; C.I. Acid Yellow 1, 3, 4, 7, 11, 12, 13, 14, 19, 23, 25, 34, 44 and 71; C.I. Food Black 1 and 2; and C.I. Acid Black 2, 7, 24, 26, 31, 52, 112 and 118.

Examples of the pigment include C.I. Pigment Blue 1, 2, 3, 15:3, 16 and 22; C.I. Pigment Red 5, 7, 12, 48(Ca), 48(Mn), 57(Ca), 112 and 122; C.I. Pigment Yellow 1, 2, 3, 13, 16 and 83; Carbon Black Nos. 2300, 900, 33, 40 and 52, MA7, MA8 and MCF88 (all, products of Mitsubishi Chemical Industries Limited); RAVEN 1255 (product of Columbian Carbon Japan Limited); REGAL 330R, REGAL 660R and MOGUL (all, products of Cabot Co.); and Color Black FW1, Color Black FW18, Color Black S170, Color Black S150 and Printex 35 (all, products of Degussa AG).

These pigments are not limited by the form thereof, and all pigments of, for example, the self-dispersing type, resin-dispersing type and microcapsule type may be used. As a pigment dispersant used at that time, may be preferably used a dispersing resin that is soluble in water and has a weight average molecular weight ranging from 1,000 to 15,000. Specific examples thereof include vinyl type water-soluble resins, block copolymers and random copolymers composed of at least two monomers selected from styrene and derivatives thereof, vinylnaphthalene and derivatives thereof, aliphatic alcohol esters of $\alpha,\beta$-ethylenically unsaturated carboxylic acids, acrylic acid and derivatives thereof, maleic acid and derivatives thereof, itaconic acid and derivatives thereof, and fumaric acid and derivatives thereof, and salts of these copolymers.

In order to improve fastness properties of an image finally formed, a water-soluble resin or water-soluble crosslinking agent may also be added. No limitation is imposed on a material used so far as it can coexist with ink components. Any of the dispersing resin described above is preferably used as the water-soluble resin. As the water-soluble crosslinking agent, oxazoline or carbodiimide that is slow in reactivity is preferably used from the viewpoint of stability of an ink prepared.

An organic solvent may be contained in the aqueous liquid medium making up the ink together with the coloring material described above. The amount of this organic solvent becomes an important factor for determining the physical properties of the ink upon the transfer of the image because in the image forming process according to the present invention, the ink at the time it is transferred from the intermediate transfer medium to the recording medium is composed of almost only the coloring material and a high-boiling organic solvent. As the organic solvent used, such a water-soluble solvent as described below is suitably used.

Examples of the water-soluble organic solvent include polyethylene glycol, polypropylene glycol, ethylene glycol, propylene glycol, butylenes glycol, triethylene glycol, thiodiglycol, hexylene glycol, diethylene glycol, ethylene glycol monomethyl ether, diethylene glycol monomethyl ether and glycerol. At least two solvents may also be selected for use in combination from among these. An alcohol such as ethyl alcohol or isopropyl alcohol, or a surfactant may also be added into the ink as a component for adjusting viscosity, surface tension and the like.

No limitation is also imposed on the mixing ratio of the components making up the ink. The ratio may be suitably adjusted within limits capable of being ejected according to an ink-jet recording system selected, ejection power of a head, a nozzle diameter and the like. In general, an ink prepared so as to contain 0.1 to 10% of the coloring material, 0.1 to 20% of the resin component, 5 to 40% of the solvent and 0.01 to 5% of the surfactant and the balance of purified water (all, based on the mass) may be used.

When the ink is ejected on the surface of the intermediate transfer medium, an image can be generally formed without problems so far as the coating layers of the wettability-improving component and image-fixing component formed previously in Steps (a) and (b) are thin. However, in some cases, the ink may be ejected after a drying step is conducted prior to Step (c) to sufficiently dry the above-described components. Upon the formation of an image, the ink is ejected taking the reversal of the image by transfer into consideration. In other words, the ink is ejected so as to form a mirror image obtained by mirror-reversing an image to be formed on the recording medium that is an objective to be transferred.

4. Step (d): Step of Transferring the Ink Image Formed on the Intermediate Transfer Medium to the Recording Medium 9

The recording medium 9 is brought into contact with the image-forming surface of the intermediate transfer medium 1 with the press roller 10 to receive the ink. According to the first embodiment of the process of the present invention, the ink has a sufficiently high viscosity on the intermediate transfer medium 1 at this state, so that a good image can be formed even on a recording medium such as printing paper little in ink absorbing quantity or a film having no ink absorbency.

It is however considered that the amount of water in the ink may not be reduced to a water quantity allowed by the recording medium by natural evaporation when the time from the formation of the ink image in Step (c) to the transfer in Step (d) is extremely short. Taking such a case into consideration, it is desirable that the device 7 for facilitating the removal of water is arranged between the formation of the ink image and the transfer as illustrated in FIG. 1 to facilitate the removal of water in the ink by such a device. As the means for facilitating the removal of water, it is effective to, for example, blow the image-formed surface, heat it or bring a heated roller 8 into contact with the intermediate transfer medium 1 from the back side thereof as illustrated in FIG. 1. When the time from Step (c) to Step (d) is extremely long, it is desirable to use a means for preventing the evaporation of the solvent in the ink or adjust the volatility of the solvent in the ink.

In the image forming apparatus according to the first embodiment of the present invention, a means for facilitating the fixing of the image formed on the recording medium may be provided. The recorded image comes to have excellent surface smoothness by pressing the recording medium by means of a fixing-facilitating device such as fixing rollers 11 illustrated in FIG. 1. Further, the fixing rollers 11 may be heated in order for a print to have good fastness properties in a moment.

In the apparatus illustrated in FIG. 1, the intermediate transfer medium after the ink image is transferred is cleaned by a cleaning unit 12 subsequently arranged for the purpose of receiving the next image. As the cleaning means, washing with water or wiping is basically used, and it is desirable to directly clean the intermediate transfer medium by showering or contact with a water surface or use a means such as wiping of the surface with a wetted Moulton roller. It goes without saying that these means may be used in combination.

As necessary, it is further effective to bring a dry Moulton roller into contact with the surface of the intermediate transfer medium or blow the surface after the cleaning, thereby drying the surface thereof. The cleaning is effectively conducted with the wettability-improving component according to the ink used. In such a case, the coating device 3 for applying the wettability-improving component as described above functions as a cleaning means.

Although the respective steps have been described above, the technical feature in the first embodiment of the present invention is abstracted by the fact that the image-fixing component can be uniformly applied to the surface of the intermediate transfer medium, or the image-fixing component can be held at a desired position on the surface of the intermediate transfer medium. The proposal that a component (image-fixing component) capable of fixing the ink image is applied to the surface of the intermediate transfer medium, thereby preventing disorder (beading, bleeding or the like) of an ink image on the intermediate transfer medium has been made in the past (see, for example, Japanese Patent Registration No. 2916864). Since the image-fixing component itself cannot be uniformly applied to the intermediate transfer medium by these proposals, or the image-fixing component cannot be held at the desired position of the surface of the intermediate transfer medium, deterioration of the ink image cannot be prevented. In order to uniformly apply the image-fixing component in the prior art, only to use a material extremely good in wettability as the intermediate transfer medium has been considered. However, the material good in wettability has high surface energy, so that the ink image is crusted through the image-fixing component to make it impossible to transfer the ink image. Alternatively, the system becomes low in transfer rate even if the ink image is not crusted. When the transfer rate is low, a greater amount of the ink must be applied to the intermediate transfer medium for the purpose of achieving a necessary image density on the recording medium. Increase in the amount of the ink applied and lowering of the transfer rate bring about the following adverse influences:

1) Increase in Bleeding and Beading:

Both bleeding and beading are caused by contact of ink droplets with each other. When the amount of the ink applied to the intermediate transfer medium is increased, the probability of bringing the ink droplets into contact with each other is also increased.

2) Increase in Amount of Water Vaporized:

When the amount of the ink per surface area on the intermediate transfer medium is increased, the time and energy required to remove water are increased, which leads to a large-scaled apparatus.

3) Deterioration of Dot Gain Upon Transfer:

The more the amount of the ink on the intermediate transfer medium, the dot diameter is more greatly collapsed by pressure upon the transfer, which forms the cause that resolution is lowered.

4) Increase in Load Upon Cleaning:

The more the amount of the ink remaining on the surface of the intermediate transfer medium after the transfer, cleaning becomes more difficult, which leads to a large-scaled apparatus.

5) Lowering of Use Efficiency of Ink:

The proportion of the ink used in the formation of an image is lowered, so that running cost becomes high, and moreover waste is also increased.

The low transfer rate is not preferable because various disadvantages are caused as described above. Accordingly, it is desirable that a high transfer rate can be realized. In order to improve the transfer rate, it is necessary to use an intermediate transfer medium having a surface of a releasable material low in surface energy or a non-absorbent material. However, the image-fixing component is repelled on the surface of the intermediate transfer medium by only applying the image-fixing component without conducting any treatment.

With the foregoing circumstances in view, these problems can be solved so far as a technique, by which the image-fixing component can be uniformly applied to the intermediate transfer medium having the surface of the releasable material or non-absorbent material, or a technique, by which the image-fixing component can be held at a desired position on the intermediate transfer medium having the surface of the releasable material or non-absorbent material, can be established.

According to the image forming process in the first embodiment of the present invention, the wettability-improving component for improving the wettability of the surface of the intermediate transfer medium is applied to the surface of the intermediate transfer medium prior to the application of the image-fixing component to the intermediate transfer medium having the surface of the releasable material or non-absorbent material, so that the image-fixing component can be uniformly applied to the intermediate transfer medium, or image-fixing component can be held at the desired position on the intermediate transfer medium. As a result, a high-quality ink image can be formed on the intermediate transfer medium, and moreover this ink image can be transferred to a recording medium at a high transfer rate. Accordingly, a high-quality image can be efficiently formed irrespective of the absorbing property of the recording medium that is an objective to be transferred.

The present invention will hereinafter be described specifically by the following EXAMPLEs and COMPARATIVE EXAMPLEs. Incidentally, all designations of "part" or "parts" and "%" as will be used in the following examples mean part or parts by mass and % by mass unless expressly noted.

EXAMPLE 1

An image-recording system of this example will hereinafter be described by steps.

(a) Application of Wettability-Improving Component:

In this example, an aluminum drum coated with a silicone rubber (KE12, trade name, product of Shinetsu Kagaku Co., Ltd.) having a rubber hardness of 40° in a thickness of 0.5 mm was used as the intermediate transfer medium. A fluorocarbon type surfactant (FTERGENT FT-400, trade name, product of NEOS Company Limited) was first applied to the surface of the intermediate transfer medium by a roll coater.

(b) Application of Image-Fixing Component:

A 10% aqueous solution of aluminum chloride hexahydrate was then applied by a roll coater.

(c) Formation of Ink Image:

A character image mirror-reversed was formed on the intermediate transfer medium, to the surface of which the above components had been applied in Steps (a) and (b), by means of an ink-jet recording apparatus (nozzle density: 1200 dpi; ejection quantity: 4 pl; drive frequency: 8 kHz). The ink used had the following composition. At this time, no beading was caused at the point of time the recorded image was formed on the intermediate transfer medium.

| | |
|---|---|
| Pigment (Carbon Black MCF88, trade name, product of Mitsubishi Kagaku Co., Ltd.) | 5 parts |
| Styrene-acrylic acid-ethyl acrylate terpolymer (acid value: 240, weight average molecular weight: 5,000) | 1 part |
| Glycerol | 10 parts |
| Ethylene glycol | 5 parts |
| Surfactant (Acetylenol EH, trade name, product of Kawaken Fine Chemicals Co., Ltd.) | 1 part |
| Ion-exchanged water | 78 parts. |

(d) Transfer:

The intermediate transfer medium after a series of the steps was brought into contact with surface-coated printing paper (Npi Coat, trade name, product of Nippon Paper Co., Ltd.; ream weight: 40.5 kg) having low ink absorbency by a press roller to transfer the recorded image on the intermediate transfer medium to the paper. At this time, no beading was observed in the image on the printing paper, and good character quality was achieved. The ink scarcely remained on the surface of the intermediate transfer medium after the transfer, and no adverse influence was observed even when the next image was received thereon.

EXAMPLE 2

An image-recording system of this example will hereinafter be described by steps.

(a) Application of Wettability-Improving Component:

In this example, an aluminum drum coated with a silicone rubber (KE30, trade name, product of Shinetsu Kagaku Co., Ltd.) having a rubber hardness of 60° in a thickness of 0.5 mm was used as the intermediate transfer medium. A fluorocarbon type surfactant (SURFLON S-141, trade name, product of SEIMI CHEMICAL Co. Ltd.) was first applied to the surface of the intermediate transfer medium by a roll coater.

(b) Application of Image-Fixing Component:

The following aqueous solution was then applied by a roll coater.

| | |
|---|---|
| Calcium chloride dihydrate | 10 parts |
| Fluorocarbon type surfactant (SURFLON S-141, trade name, product of SEIMI CHEMICAL Co. Ltd.) | 1 part |
| Crosslinking agent (Carbodilite V-02, Trade name, product of Nisshinbo Co. Ltd.) | 1 part |
| Ion-exchanged water | 88 parts. |

(c) Formation of Ink Image:

A character image mirror-reversed was formed with four color inks on the intermediate transfer medium, to the surface of which the above components had been applied in Steps (a) and (b), by means of an ink-jet recording apparatus (nozzle density: 1200 dpi; ejection quantity: 4 pl; drive frequency: 8 kHz). The inks used respectively had the following compositions. At this time, neither beading nor bleeding was caused at the point of time the recorded image was formed on the intermediate transfer medium.

| | |
|---|---|
| Each of the following pigments<br>Black: carbon black (MCF88, trade name, product of Mitsubishi Kagaku Co., Ltd.)<br>Cyan: Pigment Blue 5<br>Magenta: Pigment Red 7<br>Yellow: Pigment Yellow 74 | 5 parts |
| Styrene-acrylic acid-ethyl acrylate terpolymer (acid value: 240, weight average molecular weight: 5,000) | 1 part |
| Glycerol | 10 parts |
| Ethylene glycol | 5 parts |
| Surfactant (Acetylenol EH, trade name, product of Kawaken Fine Chemicals Co., Ltd.) | 1 part |
| Ion-exchanged water | 78 parts. |

(d) Transfer:

The recorded image surface on the intermediate transfer medium was first blown by means of an air blower arranged between the ink-jet recording apparatus and a press roll. This intermediate transfer medium was then brought into contact with surface-coated printing paper (Npi Coat, trade name, product of Nippon Paper Co., Ltd.; ream weight: 40.5 kg) having low ink absorbency by the press roller to transfer the recorded image to the paper. As a result, neither beading nor bleeding was observed in the image on the printing paper, and good image quality was achieved. The rub-off resistance of the recorded image was improved with time, and the image was completely fixed after 12 hours.

The slightly remaining inks on the intermediate transfer medium were then removed by bringing a wetted Moulton roller into contact with the transfer medium.

EXAMPLE 3

An image-recording system of this example will hereinafter be described by steps.

(a) Application of Wettability-Improving Component:

In this example, an aluminum drum coated with a silicone rubber (KE24, trade name, product of Shinetsu Kagaku Co., Ltd.) having a rubber hardness of 80° in a thickness of 0.5 mm was used as the intermediate transfer medium. A silicone type surfactant (SILWET L77, trade name, product of Nippon Unicar Co. Ltd.) was first applied to the surface of the intermediate transfer medium by a roll coater.

(b) Application of Image-Fixing Component:

A 5% aqueous solution of a high-molecular coagulant (C577S, trade name, product of Mitsui Scitech Co., Ltd.) was then applied by a roll coater.

(c) Formation of Ink Image:

A character image mirror-reversed was formed with four color inks on the intermediate transfer medium, to the surface of which the above components had been applied in Steps (a) and (b), by means of an ink-jet recording apparatus (nozzle density: 1200 dpi; ejection quantity: 4 pl; drive frequency: 8 kHz). The inks used respectively had the following compositions. At this time, no beading was caused at the point of time the recorded image was formed on the intermediate transfer medium.

| | |
|---|---|
| Each of the following dyes<br>Black: C.I. Food Black 2<br>Cyan: C.I. Direct Blue 199<br>Magenta: C.I. Acid Red 289<br>Yellow: C.I. Acid Yellow 23 | 4 parts |
| Glycerol | 10 parts |
| Diethylene glycol | 5 parts |
| Surfactant (Acetylenol EH, trade name, product of Kawaken Fine Chemicals Co., Ltd.) | 1 part |
| Ion-exchanged water | 80 parts. |

(d) Transfer:

The recorded image surface on the intermediate transfer medium was first heated by means of an infrared heater arranged between the ink-jet recording apparatus and a press roll. This intermediate transfer medium was then brought into contact with surface-coated printing paper (Npi Coat, trade name, product of Nippon Paper Co., Ltd.; ream weight: 40.5 kg) having low ink absorbency by the press roller to transfer the recorded image to the paper. As a result, no beading was observed in the image on the printing paper, and good image quality was achieved.

The slightly remaining inks on the intermediate transfer medium were then removed by bringing a wetted Moulton roller into contact with the transfer medium.

EXAMPLE 4

An image-recording system of this example will hereinafter be described by steps.

(a) Application of Wettability-Improving Component:

In this example, an aluminum drum coated with a fluororubber (AFLAS 150c, trade name, product of Asahi Glass Co., Ltd.) having a rubber hardness of 30° in a thickness of 0.7 mm was used as the intermediate transfer medium. A solid fluorocarbon type surfactant (SURFLON SC101, trade name, product of SEIMI CHEMICAL Co. Ltd.) was first brought into contact with the surface of the intermediate transfer medium to apply it.

(b) Application of Image-Fixing Component:

An image-fixing component according to the following formulation was then applied to only an image-forming portion by an ink-jet recording apparatus (nozzle density: 1200 dpi; ejection quantity: 4 pl; drive frequency: 1 kHz).

| | |
|---|---|
| Calcium chloride dihydrate | 10 parts |
| Glycerol | 10 parts |
| Diethylene glycol | 5 parts |
| Surfactant (Acetylenol EH, trade name, product of Kawaken Fine Chemicals Co., Ltd.) | 1 part |
| Ion-exchanged water | 74 parts. |

(c) Formation of Ink Image:

A character image mirror-reversed was formed with four color inks on the intermediate transfer medium, to the surface of which the above components had been applied in Steps (a) and (b), by means of an ink-jet recording apparatus (nozzle density: 1200 dpi; ejection quantity: 4 pl; drive frequency: 1 kHz). The inks used respectively had the following compositions. At this time, no beading was caused at the point of time the recorded image was formed on the intermediate transfer medium.

| | |
|---|---|
| Each of the following dyes<br>Black: C.I. Food Black 2<br>Cyan: C.I. Direct Blue 199<br>Magenta: C.I. Acid Red 289<br>Yellow: C.I. Acid Yellow 23 | 4 parts |
| Styrene-acrylic acid-ethyl acrylate terpolymer (acid value: 330, weight average molecular weight: 4,000) | 6 parts |
| Glycerol | 5 parts |
| Diethylene glycol | 5 parts |
| Surfactant (Acetylenol EH, trade name, product of Kawaken Fine Chemicals Co., Ltd.) | 1 part |
| Ion-exchanged water | 79 parts. |

(d) Transfer:

The recorded image surface on the intermediate transfer medium was first heated by means of an infrared heater arranged between the ink-jet recording apparatus and a press roll. This intermediate transfer medium was then brought into contact with surface-coated printing paper (Npi Coat, trade name, product of Nippon Paper Co., Ltd.; ream weight: 40.5 kg) having low ink absorbency by the press roller to transfer the recorded image to the paper. A heated specular metal roller (surface temperature: 60° C.) was then brought into contact under pressure with the image-recording surface to fix the image. As a result, no beading was observed in the image on the printing paper, and good image quality was achieved. The rub-off resistance right after output was also good.

The slightly remaining inks on the intermediate transfer medium were then removed by bringing a wetted Moulton roller into contact with the transfer medium.

Comparative Example 1

Image recording was conducted in the same manner as in EXAMPLE 3 except that no ink wettability-improving component was applied to the intermediate transfer medium in EXAMPLE 3. As a result, an ink image on the intermediate transfer medium was warped, and an image on the printing paper after the transfer was also not sufficient.

Comparative Example 2

Image recording was conducted in the same manner as in EXAMPLE 2 except that a butyl rubber having no releasability was used as a surface material for the intermediate transfer medium in EXAMPLE 2. As a result, ink about 1.5 times as much as the amount in EXAMPLE 2 was required to reproduce the image obtained in EXAMPLE 2, and the time required to remove water by air blowering from the formation of the image to the transfer was 1.7 times as much as the time in EXAMPLE 2. The dot gain was somewhat great compared with the image obtained in EXAMPLE 2.

Second Embodiment

In the first embodiment, has been described the process of forming an ink image on a recording medium by transferring the ink image formed on an intermediate transfer medium to the recording medium. In the second embodiment, a process of directly forming an ink image on a recording medium without using any intermediate transfer medium is described.

Figure 2:
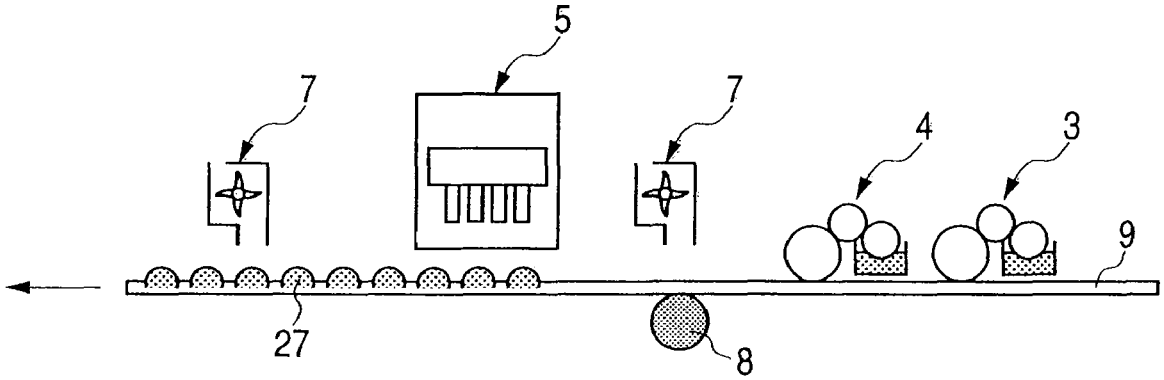
FIG. 2 illustrates a conceptual image forming apparatus according to the second embodiment of the present invention.

The second embodiment is almost the same constitution as the first embodiment expect that no intermediate transfer medium is used. As illustrated in FIG. 2, an image is formed by using a coating device 3 for applying the wettability-improving component, a coating device 4 for applying the image-fixing component, an ink-jet recording apparatus 5 for forming an ink image by ejecting an ink from an ink-jet recording head, a device 7 for facilitating removal of water and a heated roller 8. As the device 7 for facilitating removal of water, an air blower is used in this embodiment. The device 7 for facilitating removal of water and the heated roller 8 may be omitted. It is however preferable to use them.

The process of the image formation conducted by using such an image forming apparatus as illustrated in FIG. 2 is as follows. A first material (wettability-improving component) for improving the wettability of a recording medium 9 is first applied to the recording medium by the coating device 3. A second material (image-fixing component) for lowering the flowability of an ink is then applied to the recording medium to which the wettability-improving component has been applied. The wettability-improving component and image-fixing component applied to the recording medium 9 are dried by the air blower which is an example of the device 7 for facilitating removal of water and the heated roller. Thereafter, an ink is applied from the ink-jet recording apparatus 5 to apply ink dots 27 on to the recording medium, thereby forming an ink image. Lastly, the ink image formed is dried by the air blower which is an example of the device 7 for facilitating removal of water. By the process described above, an ink image can be formed even on a recording medium (for example, non-absorbent recording medium) poor in ink-absorbing ability without using any intermediate transfer medium.

According to the second embodiment, a high-quality image can be formed on various recording media irrespective of the ink-absorbing property of the recording media.

The invention claimed is:

1. An image forming apparatus comprising:

an intermediate transfer medium for transferring an image formed on a surface of the intermediate transfer medium with ink to a recording medium;

a first applying unit configured to apply a first liquid, for increasing the wettability of a surface of the intermediate transfer medium, to the intermediate transfer medium prior to formation of the image on the intermediate transfer medium with the ink;

a second applying unit configured to apply a second liquid, for decreasing the flowability of ink, to the intermediate transfer medium after the first liquid is applied to increase the wettability of the intermediate transfer medium, wherein the second liquid is substantially uniformly applied on the intermediate transfer medium;

a third applying unit configured to apply the ink to the intermediate transfer medium, to which the first liquid and the second liquid have been applied, from an ink-jet head to form an ink image on the intermediate transfer medium; and a transferring portion for transferring the ink image formed on the intermediate transfer medium to a recording medium.

2. The image forming apparatus according to claim 1, further comprising:

a control unit configured to control the first applying unit, the second applying unit, and the third applying unit, so that (i) the first liquid is applied to the intermediate transfer medium prior to the application of the second liquid, (ii) the second liquid is applied to the intermediate transfer medium after the application of the first liquid and prior to the application of the ink, and (iii) the ink is applied to the intermediate transfer medium after the application of the first liquid and the second liquid.

3. An image forming apparatus comprising:

an intermediate transfer medium for transferring an image formed on a surface of the intermediate transfer medium with an ink to a recording medium;

a first applying unit configured to apply a first liquid, containing a surfactant, to an intermediate transfer medium having a surface containing at least one material from among a fluororubber and a silicone rubber prior to formation of the image on the intermediate transfer medium with the ink;

a second applying unit configured to apply a second liquid, for aggregating a coloring material in ink, to the intermediate transfer medium after the first liquid containing the surfactant has been applied to the intermediate transfer medium, wherein the second liquid is substantially uniformly applied to the intermediate transfer medium;

a third applying unit configured to apply the ink to the intermediate transfer medium, to which the first liquid and the second liquid have been applied, from an ink-jet head to form an ink image on the intermediate transfer medium; and a transferring portion for transferring the ink image formed on the intermediate transfer medium to a recording medium.

4. The image forming apparatus according to claim 3, further comprising:

a control unit configured to control the first applying unit, the second applying unit, and the third applying unit, so that (i) the first liquid is applied to the intermediate transfer medium prior to the application of the second liquid, (ii) the second liquid is applied to the intermediate transfer medium after the application of the first liquid and prior to the application of the ink, and (iii) the ink is applied to the intermediate transfer medium after the application of the first liquid and the second liquid.

5. An image forming apparatus comprising:

an intermediate transfer medium for transferring an image formed on a surface of the intermediate transfer medium with an ink to a recording medium;

a first applying unit configured to apply a first liquid, for increasing the wettability of a surface of an intermediate transfer medium, to the intermediate transfer medium prior to formation of the image on the intermediate transfer medium with the ink;

a second applying unit configured to apply a second liquid, which reacts with ink, to the intermediate transfer medium after the first liquid is applied to increase the wettability of the surface of the intermediate transfer member, wherein the second liquid is substantially uniformly applied to the intermediate transfer medium;

a third applying unit configured to apply the ink to the intermediate transfer medium, to which the first liquid and the second liquid have been applied, from an ink-jet head to form an ink image on the intermediate transfer medium; and a transferring portion for transferring the ink image formed on the intermediate transfer medium to a recording medium.

6. The image forming apparatus according to claim 5, wherein the surface of the intermediate transfer medium contains a material containing fluorine or silicone.

7. The image forming apparatus according to claim 5, wherein the surface of the intermediate transfer medium has a rubber hardness ranging from 10 to 100°.

8. The image forming apparatus according to claim 5, wherein the first liquid contains a surfactant.

9. The image forming apparatus according to claim 5, wherein a position to which the first liquid is applied is changed according to an image to be formed.

10. The image forming apparatus according to claim 5, wherein the second liquid contains a metal ion.

11. The image forming apparatus according to claim 10, wherein the second liquid contains a surfactant.

12. The image forming apparatus according to claim 5, wherein a position to which the second liquid is applied is changed according to an image to be formed.

13. The image forming apparatus according to claim 5, wherein at least one of the first liquid, the second liquid and the ink contains a crosslinking agent.

14. The image forming apparatus according to claim 5, further comprising facilitating means for facilitating the removal of a solvent contained in the ink image formed on the intermediate transfer medium.

15. The image forming apparatus according to claim 5, wherein at least one of the first liquid and the second liquid is applied by using an ink-jet head.

16. The image forming apparatus according to claim 5, further comprising:

a control unit configured to control the first applying unit, the second applying unit, and the third applying unit, so that (i) the first liquid is applied to the intermediate transfer medium prior to the application of the second liquid, (ii) the second liquid is applied to the intermediate transfer medium after the application of the first liquid and prior to the application of the ink, and (iii) the ink is applied to the intermediate transfer medium after the application of the first liquid and the second liquid.

* * * * *